US011572207B2

(12) United States Patent
Ferrarini et al.

(10) Patent No.: US 11,572,207 B2
(45) **Date of Patent: *Feb. 7, 2023**

(54) PACKAGING APPARATUS FOR FORMING SEALED PACKAGES

(71) Applicant: Tetra Laval Holdings & Finance S.A., Pully (CH)

(72) Inventors: Filippo Ferrarini, Modena (IT); Nicola Garuti, Scandiano (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/309,327

(22) PCT Filed: Nov. 7, 2019

(86) PCT No.: PCT/EP2019/080532

§ 371 (c)(1),
(2) Date: May 19, 2021

(87) PCT Pub. No.: WO2020/108945

PCT Pub. Date: Jun. 4, 2020

(65) Prior Publication Data

US 2021/0394938 A1 Dec. 23, 2021

(30) Foreign Application Priority Data

Nov. 26, 2018 (EP) ..... 18208331

(51) Int. Cl.
*B65B 9/20* (2012.01)
*B65B 9/12* (2006.01)
(Continued)

(52) U.S. Cl.
CPC ..... *B65B 9/12* (2013.01); *B65B 9/2014* (2013.01); *B65B 31/021* (2013.01); *B65B 41/10* (2013.01); *B65B 55/103* (2013.01)

(58) Field of Classification Search
CPC ..... B65B 9/20; B65B 9/2035; B65B 9/12; B65B 9/2049; B65B 9/207; B65B 55/103; B65B 31/045; B65B 31/021; B65B 57/145
See application file for complete search history.

(56) References Cited

U.S. PATENT DOCUMENTS 3,466,841 A * 9/1969 Rausing ..... B65B 55/103 426/410
3,854,874 A * 12/1974 Loliger ..... B65B 55/103 118/DIG. 10

(Continued)

FOREIGN PATENT DOCUMENTS

CN 1272444 11/2000
CN 1630599 6/2005

(Continued)

OTHER PUBLICATIONS

International Search Report and Written Opinion of PCT/EP2019/080532, dated Feb. 11, 2020, in 8 pages.

*Primary Examiner* — Andrew M Tecco
(74) *Attorney, Agent, or Firm* — Knobbe, Martens, Olson & Bear, LLP

(57) ABSTRACT

There is described a packaging apparatus (1) for forming a plurality of sealed packages (2) from a tube (3) of a web of packaging material (4) which is continuously filled with a pourable product. The packaging apparatus comprises a delimiting element (37) arranged, in use, within the tube (3) and being designed to divide the tube (3), in use, into a first space (38) and a second space (39). The packaging apparatus (1) also comprises a sterile gas supply device (43) for pressurizing the isolation chamber and the second space (39) by means of a respectively a first flow of sterile gas and a second flow of sterile gas.

17 Claims, 3 Drawing Sheets

(51) Int. Cl.

| | |
|---|---|
| ***B65B 31/02*** | (2006.01) |
| ***B65B 41/10*** | (2006.01) |
| ***B65B 55/10*** | (2006.01) |

(56) References Cited

U.S. PATENT DOCUMENTS

| | | | | | |
|---|---|---|---|---|---|
| 4,784,697 | A * | 11/1988 | Bordini | B65B 55/02 | 53/551 |
| 4,809,485 | A * | 3/1989 | Nielsen | B65B 39/00 | 53/503 |
| 5,044,140 | A * | 9/1991 | Iwano | B67C 3/002 | 141/90 |
| 6,588,174 | B2 * | 7/2003 | Yamamoto | B65B 41/18 | 53/64 |
| 7,827,768 | B2 * | 11/2010 | Rosberg | B65B 9/20 | 53/551 |
| 8,707,661 | B2 * | 4/2014 | Kinoshita | B29C 66/81429 | 53/503 |
| 8,707,662 | B2 * | 4/2014 | Borsari | B29C 66/83413 | 53/550 |
| 8,938,938 | B2 * | 1/2015 | Konno | B29C 66/1122 | 53/554 |
| 8,943,786 | B2 * | 2/2015 | Konno | B29C 65/7451 | 53/511 |
| 9,238,515 | B2 * | 1/2016 | Persson | B65B 9/20 | |
| 9,637,260 | B2 * | 5/2017 | Ghirardello | B65B 51/30 | |
| 10,875,675 | B2 * | 12/2020 | Benedetti | B65B 55/04 | |
| 2001/0047641 | A1 * | 12/2001 | Kume | B65B 51/303 | 53/493 |
| 2005/0076612 | A1 * | 4/2005 | Andersson | B65B 55/103 | 53/551 |
| 2009/0223173 | A1 * | 9/2009 | Rapparini | B65B 55/106 | 53/469 |
| 2011/0099955 | A1 * | 5/2011 | Konno | B65B 55/025 | 53/545 |
| 2011/0185686 | A1 * | 8/2011 | Konno | B29C 65/7451 | 53/548 |
| 2011/0192113 | A1 * | 8/2011 | Kinoshita | B65B 9/2049 | 53/52 |
| 2012/0266571 | A1 * | 10/2012 | Persson | B65B 31/045 | 53/473 |
| 2014/0196407 | A1 * | 7/2014 | Ghirardello | B65B 9/20 | 53/167 |
| 2016/0122051 | A1 * | 5/2016 | Andersson | B65B 31/045 | 53/510 |

FOREIGN PATENT DOCUMENTS

| | | |
|---|---|---|
| CN | 200988594 | 12/2007 |
| CN | 102131707 | 7/2011 |
| CN | 102686483 | 9/2012 |
| CN | 112638777 | 4/2021 |
| EP | 1334912 A1 | 8/2003 |
| EP | 1795448 | 6/2007 |
| GB | 869759 | 6/1961 |
| JP | H01111633 | 4/1989 |
| WO | WO 2014/195112 | 12/2014 |

* cited by examiner

PACKAGING APPARATUS FOR FORMING SEALED PACKAGES

TECHNICAL FIELD

The present invention relates to a packaging apparatus for forming sealed packages, in particular for forming sealed packages filled with a pourable product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding a laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on a fully automatic packaging apparatus, which advances a web of packaging material through a sterilization unit for sterilizing the web of packaging material, e.g. by means of chemical sterilization (e.g. by applying a chemical sterilizing agent, such as a hydrogen peroxide solution) or physical sterilization (e.g. by means of an electron beam). Then, the sterilized web of packaging material is maintained and advanced within an isolation chamber, and is folded and sealed longitudinally to form a tube, which is further fed along a vertical advancing direction.

In order to complete the forming operations, the tube is continuously filled with a sterilized or sterile-processed pourable food product, and is transversally sealed and subsequently cut along equally spaced transversal cross sections within a package forming unit of the packaging apparatus during advancement along the vertical advancing direction.

Pillow packages are so obtained within the packaging apparatus, each pillow package having a longitudinal sealing band and a top transversal sealing band and a bottom transversal sealing band.

Furthermore, a typical packaging apparatus comprises a conveying device for advancing a web of packaging material along an advancement path, a sterilizing unit for sterilizing the web of packaging material, a tube forming and sealing device partially arranged within an isolation chamber and being adapted to form the tube from the advancing web of packaging material and to longitudinally seal the tube along a longitudinal seam portion of the tube, a filling pipe, in use, being coaxially arranged to and within the tube for continuously filling the tube with the pourable product and a package forming unit adapted to produce the single packages from the tube of packaging material by forming, transversally sealing and transversally cutting the packages.

The package forming unit comprises a plurality of forming, sealing and cutting assemblies, each one, in use, advancing along a respective operative path parallel to the advancement path of the tube. During advancement of the forming, sealing and cutting assemblies these start to interact with the tube at a hit position and follow the advancing tube so as to form, to transversally seal and to transversally cut the tube so as to obtain the single packages.

In order to correctly form the single packages, it is required that the hydrostatic pressure provided by the pourable product within the tube is sufficiently high as otherwise irregularly shaped packages would be obtained.

Typically, the column of pourable product present in the tube for providing the required hydrostatic pressure extends at least 500 mm upwards from the hit position (i.e. the station at which the respective forming, sealing and cutting assemblies start to contact the advancing tube). In some cases, the pourable product column extends up to 2000 mm upwards from the hit position. It is known in the art that the exact extension depends at least on the package format and the production speeds.

In practice, this means that the tube must have an extension so as to provide for the required pourable product column within the tube.

Therefore, the vertical extension of the isolation chamber of the packaging apparatus must be rather elevated in order to provide the needed level of pourable product within the tube.

The required hydrostatic pressure is dependent on production parameters, such as the advancement speed of the web of packaging material and, accordingly, of the advancement speed of the tube (in other words, it is dependent on the processing speed of the packaging apparatus), on the package format and the package volume. This means that, if any production parameter is to be varied, it is necessary that one or more operators modify the packaging apparatus accordingly. The needed modifications are lengthy in time and, thus, lead to increasing production costs.

A need is felt in the sector to improve the packaging apparatuses. In particular, so as to overcome at least one of the above-mentioned disadvantages.

DISCLOSURE OF INVENTION

It is therefore an object of the present invention to provide in a straightforward and low-cost manner an improved packaging apparatus.

According to the present invention, there is provided a packaging apparatus as claimed in claim 1.

Further advantageous embodiments of the packaging apparatus according to the invention are specified in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
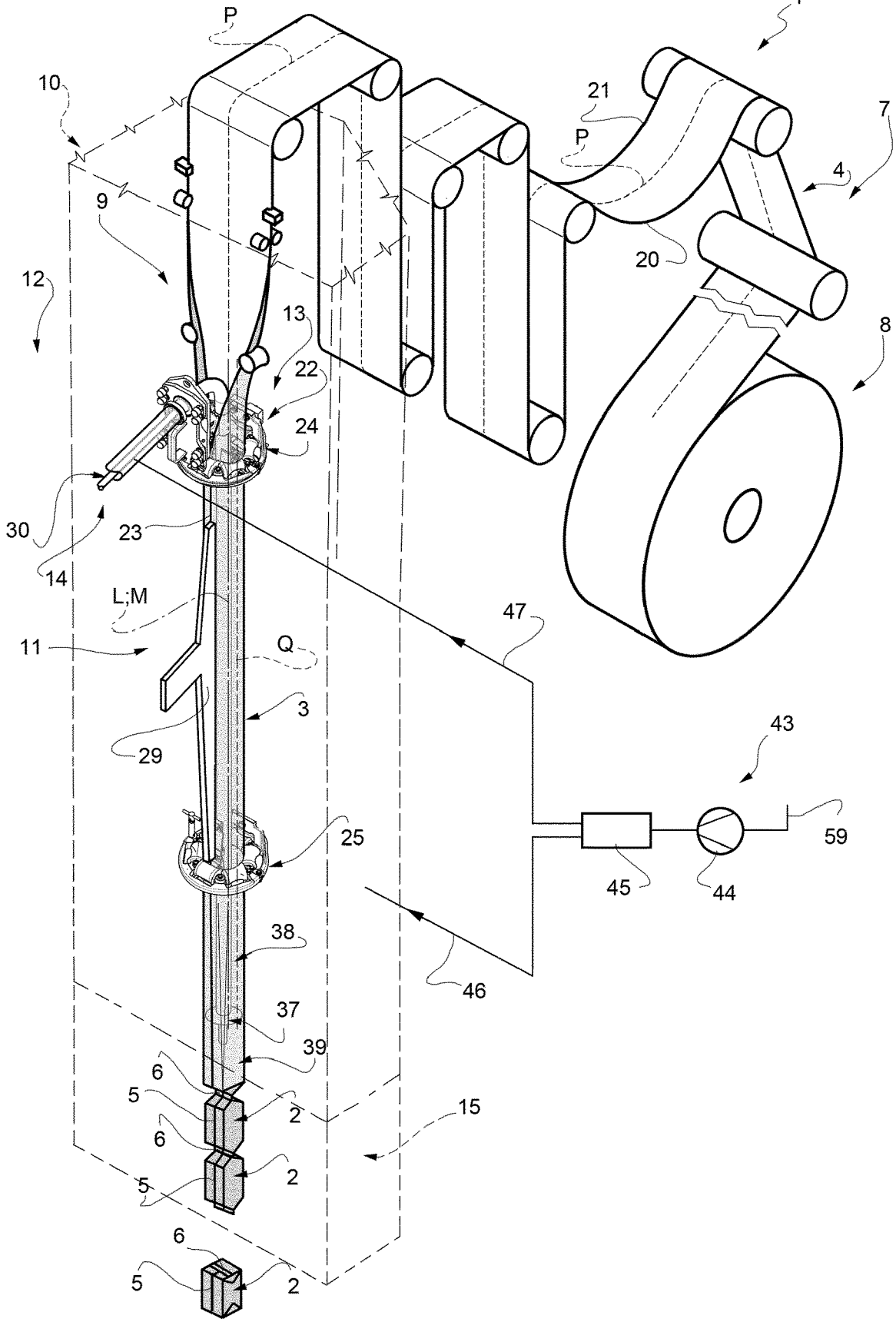
FIG. 1 is a schematic view of a packaging apparatus according to the present invention, with parts removed for clarity.

Number 1 indicates as a whole a first embodiment of a packaging apparatus for producing sealed packages 2 of a pourable food product, in particular a sterilized and/or a sterile-processed pourable food product, such as pasteurized milk or fruit juice, from a tube 3 of a web 4 of packaging material. In particular, in use, tube 3 extends along a longitudinal axis L, in particular, axis L having a vertical orientation.

Web 4 of packaging material has a multilayer structure (not shown), and comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defining the inner face of package 2 eventually contacting the pourable product.

Preferably but not necessarily, web 4 also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, web 4 also comprises a further layer of heat-seal plastic material being interposed between the layer of gas- and light-barrier material and the layer of fibrous material.

A typical package 2 obtained by packaging apparatus 1 comprises a sealed longitudinal seam portion 5 and a pair of transversal seal portions 6, in particular a top transversal seal portion 6 and a bottom transversal seal portion 6 (i.e. one transversal seal portion 6 at an upper portion of package 2 and another transversal seal portion 6 at a lower portion of package 2).

Figure 2:
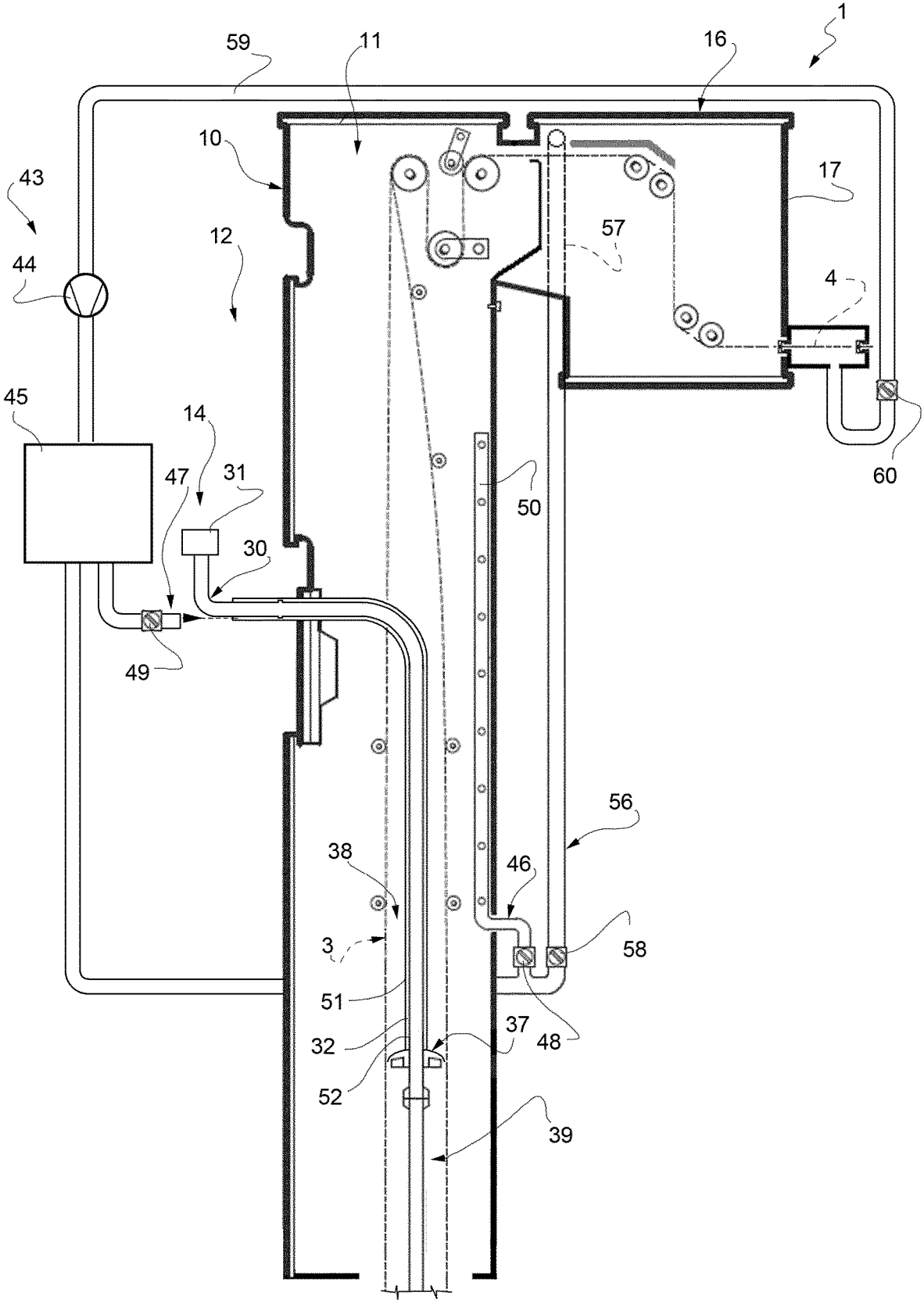
FIG. 2 is a schematic view of details of the packaging apparatus of FIG. 1, with parts removed for clarity.

With particular reference to FIGS. 1 and 2, packaging apparatus 1 comprises:

a conveying device 7 configured to advance web 4 (in a manner known as such) along a web advancement path P from a delivery station 8 to a forming station 9, at which, in use, web 4 is formed into tube 3;

an isolation chamber 10 having an inner environment 11, in particular an inner sterile environment, containing (comprising) a sterile gas, in particular sterile air, and being separated from an outer environment 12;

a tube forming and sealing device 13 being at least partially arranged within isolation chamber 10 and being adapted to form and longitudinally seal tube 3, in particular at tube forming station 9, from the, in use, advancing web 4;

a filling device 14 for continuously filling tube 3 with the pourable product; and in particular, a package forming unit 15 adapted to form, to transversally seal and, preferably but not necessarily to transversally cut the, in use, advancing tube 3 for forming packages 2.

Preferably but not necessarily, packaging apparatus 1 also comprises a sterilizing unit 16 (only partially shown in FIG. 2) adapted to sterilize the, in use, advancing web 4 at a sterilization station, in particular the sterilization station being arranged upstream of forming station 9 along path P. Even more particular, sterilization unit 16 is arranged upstream of isolation chamber 10 along path P.

In particular, sterilizing unit 16 is configured to sterilize web 4 by means of chemical sterilization (e.g. e.g. by applying a chemical sterilizing agent, such as a hydrogen peroxide solution) and/or physical sterilization (e.g. electron beam or other electromagnetic irradiation).

Even more particular, sterilization unit 16 comprises a housing 17 (delimiting a sterilization space) through which web 4 advances, in use, during the sterilization of web 4.

According to a preferred non-limiting embodiment, at least a portion of sterilization unit 16, in particular housing 17, is mechanically connected to isolation chamber 10.

Preferably but not necessarily, sterilization unit 16 and isolation chamber 10 are arranged such that, in use, web 4 advancing along path P enters into isolation chamber 10 from sterilization unit 16.

Preferentially but not necessarily, conveying device 7 is configured to advance tube 3 and, in particular also any intermediate of tube 3, in a manner known as such along a tube advancement path Q, in particular from forming station 9 to and at least partially through package forming unit 15.

In particular, with the wording intermediates of tube 3 any configuration of web 4 is meant prior to obtaining the tube structure and after folding of web 4 by tube forming device 13 has started. In other words, the intermediates of tube 3 are a result of the gradual folding of web 4 so as to obtain tube 3, in particular by overlapping with one another a first edge 20 of web 4 and a second edge 21 of web 4, opposite to first edge 20.

Preferentially but not necessarily, tube forming and sealing device 13 comprises a tube forming unit 22 at least partially, preferably fully, arranged within isolation chamber 10, in particular at tube forming station 9, and being adapted to (configured to) gradually fold the advancing web 4 into tube 3, in particular by overlapping first edge and second edge 21 with one another, for forming a longitudinal seam portion 23 of tube 3. In particular, tube forming unit 22 extends along a longitudinal axis M, in particular having a vertical orientation.

In particular, seam portion 23 extends from an initial level (not specifically shown) into a downward direction along path Q. In other words, the initial level is at the position at which first edge 20 and second edge 21 start to overlap one another for forming seam portion 23.

In particular, at least a portion of path Q lies within isolation chamber 10 (in particular, within inner environment 11).

In more detail, axis L and axis M are parallel to one another. In even more detail, tube forming unit 22 defines, in use, axis L of tube 3.

Preferentially but not necessarily, tube forming unit 22 comprises at least two forming ring assemblies 24 and 25, in particular arranged within isolation chamber 10 (in particular, within inner environment 11), being adapted to gradually fold in cooperation with one another web 4 into tube 3, in particular by overlapping first edge 20 and second edge 21 with one another for forming longitudinal seam portion 23.

Even more particular, forming ring assemblies 24 and 25 are spaced apart from, and parallel to, one another.

Furthermore, forming ring assemblies 24 and 25 are arranged coaxial to one another and define longitudinal axis M of tube forming unit 22.

Preferentially but not necessarily, tube forming and sealing device 13 also comprises a sealing unit adapted to (configured to) longitudinally seal tube 3 along seam portion 23. In other words, in use, seam portion 23 formed by tube forming unit 22 is sealed by activation of the sealing unit.

Preferentially but not necessarily, the sealing unit is at least partially positioned within isolation chamber 10.

It must be noted that the respective longitudinally sealed seam portions 5 of the single packages 2 result from transversally sealing and cutting tube 3. In other words, the respective seam portions 5 of the single packages 2 are respective sections of seam portion 23 of tube 3.

More specifically, the sealing unit comprises a sealing head 29 arranged within isolation chamber 10 and being adapted to (configured to) transfer thermal energy to tube 3, in particular to seam portion 23 for longitudinally sealing tube 3, in particular seam portion 23. Sealing head 29 can be of any type. In particular, sealing head 29 can be of the kind operating by means of induction heating and/or by a stream of a heated gas and/or by means of ultrasound and/or by laser heating and/or by any other means.

Preferentially but not necessarily, the sealing unit also comprises a pressing assembly adapted to exert a mechanical force on tube 3, in particular on the substantially overlapping first edge 20 and second edge 21, even more particular onto seam portion 23, so as to ensure the longitudinal sealing of tube 3 along seam portion 23.

In particular, the pressing assembly comprises at least an interaction roller (not shown) and a counter-interaction roller (not shown) adapted to exert the mechanical force onto seam portion 23 from opposite sides thereof. In particular, in use, seam portion 23 is interposed between the interaction roller and the counter-interaction roller.

Preferentially but not necessarily, the interaction roller is supported by forming ring assembly 25.

In more detail, sealing head 29 is arranged substantially between forming ring assemblies 24 and 25.

Figure 3:
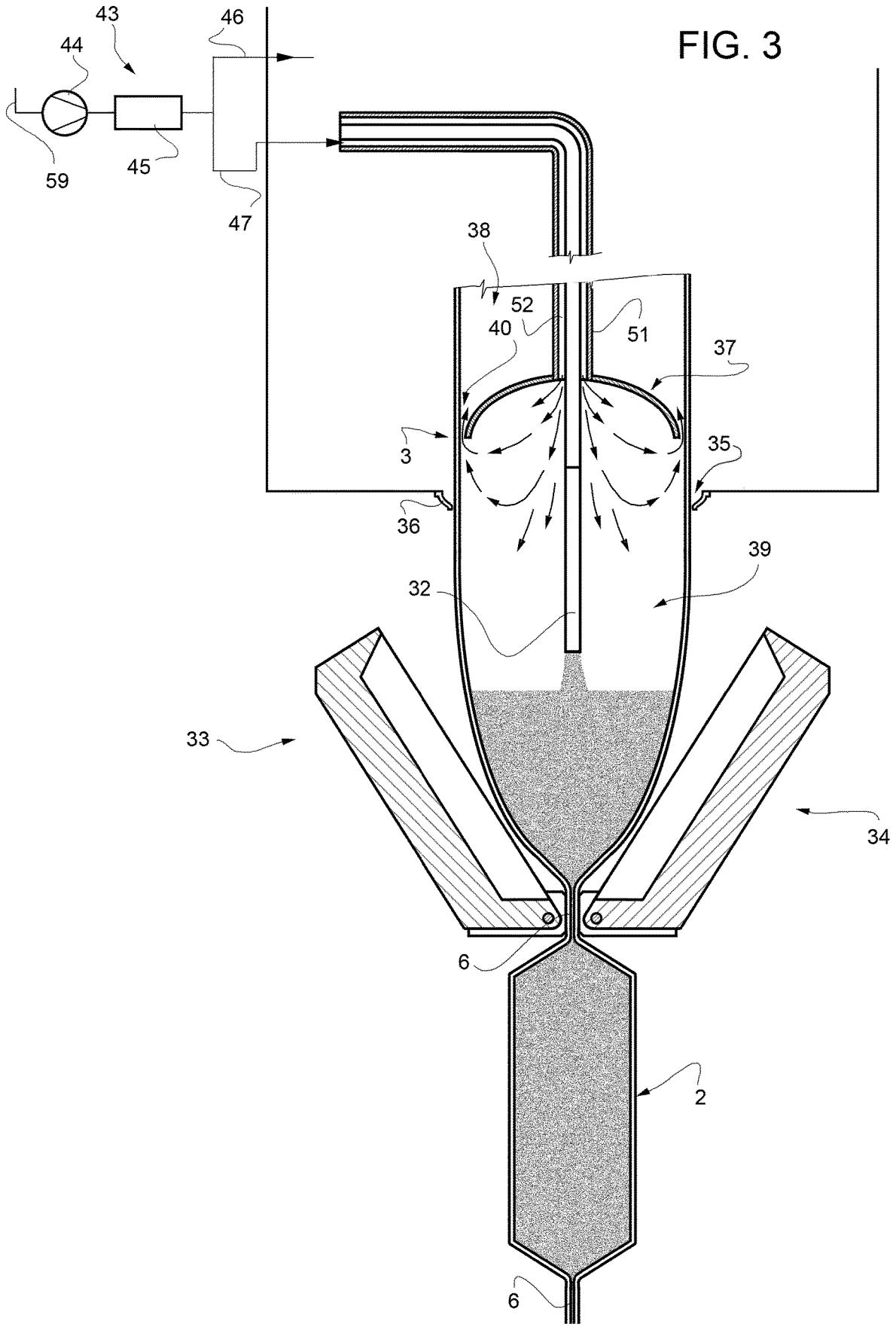
FIG. 3 is an enlarged schematic view of a portion of the packaging apparatus of FIG. 1, with parts removed for clarity.

With particular reference to FIGS. 1 to 3, filling device 14 comprises a filling pipe 30 being in fluid connection with a pourable product storage tank 31, which is adapted to store/provide for the pourable product, in particular the sterilized and/or sterile-processed pourable food product, to be packaged.

In particular, filling pipe 30 is adapted to (configured to) direct, in use, the pourable product into tube 3.

Preferentially but not necessarily, filling pipe 30 is, in use, at least partially placed within tube 3 for continuously feeding the pourable product into tube 3.

In particular, filling pipe 30 comprises a linear main pipe portion 32 of filling pipe 30 extending within and (substantially) parallel to tube 3, i.e. parallel to axis M and axis L.

According to a preferred non-limiting embodiment as shown in FIG. 3, package forming unit 15 comprises a plurality of pairs of at least one respective operative assembly 33 and at least one counter-operative assembly 34; and in particular, a conveying device (not shown and known as such) adapted to advance the respective operative assemblies 33 and the respective counter-operative assemblies 34 of the pairs along respective conveying paths.

In more detail, each operative assembly 33 is adapted to cooperate, in use, with the respective counter-operative assembly 34 of the respective pair for forming a respective package 2 from tube 3. In particular, each operative assembly and the respective counter-operative assembly 34 are configured to form, to transversally seal and, preferably but not necessarily also to transversally cut, tube 3 for forming packages 2.

In further detail, each operative assembly 33 and the respective counter-operative assembly 34 are adapted to cooperate with one another for forming a respective package 2 from tube 3 during, in use, advancement along a respective operative portion of the respective conveying path. In particular, during advancement along the respective operative portion each operative assembly 33 and the respective counter-operative assembly 34 advance parallel to and in the same direction as tube 3.

In even more detail, each operative assembly 33 and the respective counter-operative assembly 34 are configured to contact tube 3 when advancing along the respective operative portion of the respective conveying path. In particular, each operative assembly 33 and the respective counter-operative assembly 34 are configured to start to contact tube 3 at a (fixed) hit position.

Preferentially but not necessarily, filling device 14 is configured to direct the pourable product, in particular through filling pipe 30, into tube 3 such that the extension of the pourable product column present in tube 3 from the hit position in an upstream direction (with respect to path Q) is less than 500 mm. Even more preferably, the extension of the pourable product column from the hit position in the upstream direction should lie within a range of about 100 mm to 500 mm.

With particular reference to FIGS. 1 to 3, isolation chamber 10 comprises an outlet-opening 35 for allowing tube 3 to exit isolation chamber 10 during advancement along path Q. In particular, outlet-opening 35 is arranged downstream of tube forming station 9 along path Q.

Preferably but not necessarily, outlet-opening 35 is arranged in the area of a downstream (end) portion of isolation chamber 10.

Preferentially but not necessarily, isolation chamber 10 also comprises an inlet-opening, opposite to outlet-opening 35, and configured to allow entrance of (sterile) web 4 into isolation chamber 10. In particular, the inlet-opening is positioned in an upstream portion of isolation chamber 10. Even more particular, the inlet-opening is arranged adjacent to an outlet of sterilization unit 16 from which web 3 exits, in use, from sterilization unit 16.

According to a preferred non-limiting embodiment, isolation chamber 10 comprises at least one (downstream) sealing assembly 36 configured to seal, in use, outlet-opening 35 in cooperation with the, in use, advancing tube 3. In particular, (downstream) sealing assembly 36 is configured to at least partially hinder, in particular to (substantially) impede, entrance of gas from outside of isolation chamber 10 (i.e. from outer environment 12) through outlet-opening 35 into isolation chamber 10. In other words, the (downstream) sealing assembly 36 is configured to at least partially impede a flow of gas from outer environment 12 into inner environment 11.

Preferentially but not necessarily, as will be explained in more detail below, the pressure within isolation chamber 10 is (slightly) above ambient pressure for reducing the risk of any contaminants and/or contaminations entering inner environment 11. In particular, in use, the pressure within isolation chamber 10 is about 100 Pa to 500 Pa (0.001 bar to 0.005 bar) above ambient pressure.

According to the present invention and with particular reference to FIGS. 2 and 3, packaging apparatus 1 also comprises a delimiting element 37 placed, in use, within tube 3 and designed to divide tube 3, in use, into a first space 38 and a second space 39.

Preferably but not necessarily, delimiting element 37 is arranged within isolation chamber 10.

According to a preferred non-limiting embodiment, delimiting element 37 is arranged upstream of outlet-opening 35 along tube advancement path Q.

According to a preferred non-limiting embodiment, delimiting element 37 is arranged such to be adapted to move parallel and/or perpendicular to the, in use, advancing tube (i.e. parallel to axis M and/or axis L). In other words, preferentially but not necessarily, delimiting element 37 is arranged in a floating manner.

In more detail, first space 38 is delimited by tube 3, in particular the walls of tube 3, and delimiting element 37. Furthermore, first space 38 opens into inner environment 11. Even more particular, delimiting element 37 delimits first space 38 at a downstream portion (with respect to path Q), in particular a bottom portion, of first space 38 itself.

Preferably but not necessarily, first space 38 is in (direct) fluidic connection with inner environment 11. Thus, sterile gas present in first space 38 can flow, in use, to inner environment 11 and vice versa.

According to a preferred non-limiting embodiment, the pressure inside first space 38 (substantially) equals the pressure present in isolation chamber 10.

In more detail, second space 39 is delimited, in use, by tube 3, in particular the walls of tube 3, delimiting element 37 and the transversal seal portion 6 of one respective package 2 (to be formed).

In other words, second space 39 extends in a direction parallel to path Q (i.e. parallel to axis L) from delimiting element 37 to transversal seal portion 6.

In even other words, delimiting element 37 delimits second space 39 at an upstream portion (with respect to path Q), in particular an upper portion, of second space 39 itself; and transversal seal portion 6 delimits second space 39 at a downstream portion (with respect to path Q), in particular a bottom portion, of second space 39 itself.

In further detail, first space 38 is arranged upstream of second space 39 along tube advancement path Q. Even more particular, first space 38 is arranged upstream of delimiting element 37 along path Q and second space 39 is arranged downstream of delimiting element 37 along path Q. In the specific example shown, second space 39 is placed below first space 38.

More specifically, delimiting element 37 is arranged, in use, downstream of the above-mentioned initial level along path Q. In other words, delimiting element 37 is positioned below the point from which seam portion 23 extends along a downstream direction (with respect to path Q). In even other words, delimiting element 37 is arranged below the position from which first edge 20 and second edge 21 are superimposed for forming seam portion 23.

In further detail, second space 39 is delimited by delimiting element 37 and the respective transversal seal portion 6 of the respective package 2, in particular the transversal seal portion 6 being, in use, placed downstream of delimiting element 37.

Furthermore, in use, filling device 14, in particular filling pipe 30, is adapted to (configured to) direct the pourable product into second space 39. As well, as will be disclosed in more detail below, second space 39 contains the pourable product and a sterile gas directed into second space 39 itself. In particular, the gas pressure within second space 39 is higher than the pressure within isolation chamber 10 (and first space 38).

Preferably but not necessarily, delimiting element 37 is designed to provide, in use, for at least one fluidic channel 40, in particular having an annular shape, for fluidically connecting second space 39 with first space 38 allowing for, in use, a leakage flow of a sterile gas from second space 39 into first space 38. In particular, in use, the sterile gas leaks from second space 39 to first space 38 through fluidic channel 40.

Preferentially but not necessarily, in use, delimiting element 37 is designed such that, in use, fluidic channel 40 is provided by a gap between the inner surface of tube 3 and delimiting element 37, in particular a peripheral portion of delimiting element 37. In other words, in use, delimiting element 37 and the inner surface of tube 3 do not touch each other. Thus, no wear of delimiting element 37 occurs due to an interaction between delimiting element 37 and tube 3. As well, delimiting element 37 does not damage, in use, the inner surface of tube 3.

In alternative or in addition, delimiting element 37 could comprise one or more passages for allowing a fluidic connection between first space 38 and second space 39.

In further detail, delimiting element 37 has a radial extension being smaller than the inner diameter of tube 3. Preferentially but not necessarily, in case of a format change leading to a change of the inner diameter of tube 3, delimiting element 37 can be replaced by a new delimiting element 37 having the required and/or suited radial extension.

In the specific case shown, delimiting element 37 has a curved outer profile. Alternatively, other configurations of delimiting element 37 could be chosen, such as having a substantially straight shape or having a straight central portion and a curved peripheral portion.

Advantageously, packaging apparatus 1 also comprises a sterile gas supply device 43 configured to generate and to pressurize a sterile gas, in particular sterile air, and to divide the generated and pressurized sterile gas at least into a first flow of sterile gas and at least a second flow of sterile gas.

Sterile gas supply device 43 is also configured to direct the first flow of the sterile gas into isolation chamber 10 and the second flow of the sterile gas into second space 39 and to control the first flow of sterile gas and the second flow of sterile gas such that the gas pressure within second space 39 is higher than the gas pressure within isolation chamber 10 and, preferentially the pressure inside first space 38. In particular, in use, these pressures guarantee that there is a flow of gas from second space 39 into isolation chamber 10, in particular through fluidic channel 40 and first space 38. Preferentially, in use, a flow of gas from isolation chamber 10 into second space 39 is not possible.

According to a preferred non-limiting embodiment, in use, second space 39 contains the pourable product and the pressurized sterile gas. The pressurized sterile gas provides for the required hydrostatic force needed for a correct forming of packages 2 (i.e. in other words, the sterile gas replaces the effect of the pourable product column within tube 3), in particular allowing to reduce the extension of the pourable product column.

According to a preferred non-limiting embodiment, sterile gas supply device 43 is configured such to control the gas pressure within second space 39 to range between 5 kPa to 40 kPa (0.05 bar to 0.40 bar), in particular between 10 kPa to 30 kPa (0.10 bar to 0.30 bar), above ambient pressure. In particular, sterile gas supply device 43 is configured to control the pressure within second space 39 by controlling the second flow of sterile gas into the second space 39 and by that the sterile gas is delimited between delimiting element 37 and the pourable product.

Preferentially but not necessarily, sterile gas supply device 43 is also configured such to control the gas pressure within isolation chamber 10 (as already mentioned above) to range between 100 Pa to 500 Pa (0.001 bar to 0.005 bar) above ambient pressure.

According to a preferred non-limiting embodiment, sterile gas supply device 43 comprises a pressurizing unit 44, in particular a compressor, and a sterilization assembly 45 configured to respectively pressurize and sterilize a gas for generating the pressurized and sterile gas.

Preferably but not necessarily, pressurizing unit 44 and sterilization assembly 45 are fluidically connected to one another and are arranged such that sterilization assembly 45 receives, in use, the pressurized gas so as to sterilize the pressurized gas. In other words, in use, the gas is sterilized after having been pressurized.

According to a preferred non-limiting embodiment, sterilization assembly 45 is configured to heat the (pressurized) gas, in particular the pressurized gas, in order to induce a disintegration of any unwanted molecules and/or compositions (such as contaminations, microbes, etc.) present within the gas. In particular, sterilization assembly 45 is configured to heat the (pressurized) gas to a temperature between 300 to 400° C.

Preferably but not necessarily, pressurizing unit 44 is also configured to extract directly or indirectly gas from isolation chamber 10, to pressurize the extracted gas and to direct the pressurized gas to sterilization assembly 45. In particular, pressurizing unit 44 is configured to exert a suction force so as to extract gas from isolation chamber 10. Even more particular, pressurizing unit 44 is in direct fluidic connection with housing 17 and is configured to exert a suction force on the gas present within the sterilization space so as to extract the gas from isolation chamber 10.

Advantageously but not necessarily, sterile gas supply device 43 at least partially defines a closed sterile gas circuit from inner environment 11 into the sterilization space and back into inner environment 11 through pressurizing unit 44 and sterilization assembly 45.

According to a preferred non-limiting embodiment, sterile gas supply device 43 also comprises a gas inlet so as to introduce (fresh) gas, in particular (fresh) air, into sterile gas supply device 43 itself and/or the closed circuit.

With particular reference to FIG. 2, sterile gas supply device 43 comprises at least:

a first gas feeding conduit 46 being fluidically connected with inner environment 11 configured to direct, in use, the first flow of sterile gas into isolation chamber 10; and a second gas feeding conduit 47 configured to direct, in use, the second flow of sterile gas into second space 39.

According to a preferred non-limiting embodiment, sterile gas supply device 43 comprises a first control valve 48 configured to control the first flow of sterile gas and a second control valve 49 configured to control the second flow of sterile gas.

More specifically, first control valve 48 is arranged within first gas feeding conduit 46 and second control valve 49 is arranged within second gas feeding conduit 47.

Preferentially but not necessarily, first gas feeding conduit 46 and second gas feeding conduit 47 are fluidically connected to sterilization assembly 45 so as to receive the pressurized and sterilized gas.

In particular, first gas feeding conduit 46 comprises an injection portion 50 configured to inject and/or to direct the sterile gas of the first flow of sterile gas into isolation chamber 10. Even more particular, injection portion 50 extends at least partially within isolation chamber 10 and has one or more injection nozzles and/or injection outlets.

In particular, second gas feeding conduit 47 comprises at least a main inlet portion 51, which, in use, extends within tube 3. In particular, main inlet portion 51 extends parallel to main pipe portion 32.

Even more particular, at least main inlet portion 51 and main pipe portion 32 are coaxial to one another.

In the specific non-limiting example shown, filling pipe 30, in particular main pipe portion 32, extends at least partially within main inlet portion 51. Alternatively, main inlet portion 51 could at least partially extend within filling pipe 30, in particular main pipe portion 32.

In particular, the cross-sectional diameter of main pipe portion 32 is smaller than the cross-sectional diameter of main inlet portion 51.

Preferentially but not necessarily, main inlet portion 51 and main pipe portion 32 define/delimit an annular conduit 52 for the sterile gas of the second flow of sterile gas to be fed into second space 39.

Preferentially but not necessarily, delimiting element 37 is connected to main inlet portion 51 and/or main pipe portion 32, in the specific case shown to main inlet portion 51, in particular in a floating manner.

Preferentially but not necessarily, sterile gas supply device 43 is also configured to direct a third flow of sterile gas into housing 17, in particular in the area of the interface between isolation chamber 10 and housing 17. In particular, sterile gas supply device 43 comprises a third gas feeding conduit 56 configured to direct the third flow of sterile gas into the sterilization space, in particular in the area of the interface between isolation chamber 10 and housing 17 (i.e. in the area of the interface between the sterilization space and inner environment 11).

In more detail, third gas feeding conduit 56 is fluidically connected to sterilization assembly 45 so as to receive the pressurized and sterilized gas. In particular, third gas feeding conduit 56 comprises at least an injection portion 57 extending within housing 17.

According to a preferred non-limiting embodiment, sterile gas supply device 43 also comprises a third control valve 58 configured to control the third flow of sterile gas. In particular, third control valve 58 is arranged within third gas feeding conduit 56.

Preferentially but not necessarily, sterile gas supply device 43 also comprises a return conduit 59 configured to receive the gas extracted from isolation chamber 10 and to direct it towards (and to) pressurizing unit 44.

In particular, return conduit 59 is fluidically connected to pressurizing unit 44. Even more particular, return conduit 59 is also fluidically (and mechanically) connected to sterilization unit 16 and is configured to receive gas flowing from inner environment 11 and through the sterilization space.

Preferentially but not necessarily, sterile gas supply device 43 also comprises a fourth control valve 60 configured to control the flow of gas through return conduit 59. In particular, fourth control valve 60 is configured to control the flow of gas being extracted from isolation chamber 10 and/or sterilization unit 16.

According to a preferred non-limiting embodiment, at least first gas feeding conduit 46 and return conduit 59, preferentially also second gas feeding conduit 47, even more preferentially also third gas feeding conduit 56, define at least a portion of the closed circuit.

In use, packaging apparatus 1 forms packages 2 filled with a pourable product. In particular, packaging apparatus 1 forms packages 2 from tube 3 formed from web 4, tube 3 being continuously filled with the pourable product.

In more detail, operation of packaging apparatus 1 comprises:

a first advancement step for advancing web 4 along path P;

a tube forming and sealing step during which web 4 is formed into tube 3 and tube 3 is longitudinally sealed, in particular along seam portion 23;

a second advancement step during which tube 3 is advanced along path Q;

a filling step during which the pourable product is filled into tube 3; and a package forming step during which packages 2 are formed from tube 3, in particular by forming (respective (lower) portions) of tube 3 and transversally sealing and cutting tube 3.

In further detail, the tube forming and sealing step comprises the sub-step of gradually overlapping first edge and second edge 21 with one another for forming seam portion 23 and the sub-step of longitudinally sealing tube 3, in particular seam portion 23.

The filling step comprises the sub-step of directing the pourable product through filling pipe 30 into second space 39.

During the package forming step, packages 2 are formed by operation of package forming unit 15, which receives tube 3 after the tube forming and sealing step. In particular, during the package forming step operative assemblies 33 and counter-operative assemblies 34 are advanced along their respective conveying paths. When operative assemblies 33 and their respective counter-operative assemblies 34 advance along their respective operative portions, operative assemblies 33 and the respective counter-operative assemblies 34 cooperate with one another for forming, transversally sealing and, preferably but not necessarily, transversally cutting advancing tube 3 so as to form packages 2. During the package forming step, the pourable product is continuously directed into second space 39 so as to obtain filled packages 2.

According to a preferred non-limiting embodiment, operation of packaging apparatus 1 also comprises the step of conditioning, during which gas, in particular air, is pressurized, in particular by pressurizing unit 44, and sterilized, in particular by sterilization assembly 45. Preferentially but not necessarily, the gas is at first pressurized and then sterilized.

Operation of packaging apparatus 1 also comprises a pressurizing step during which the first flow of sterile gas is directed into isolation chamber 10 and the second flow of sterile gas is directed, in particular continuously directed, into second space 39.

In particular, the pressurized and sterilized gas obtained during the conditioning step is used during the pressurizing step.

In more detail, during the pressurizing step, the sterile gas of the first flow of sterile gas and of the second flow of sterile gas is directed, in particular continuously directed, into respectively isolation chamber 10 and second space 39.

Preferentially but not necessarily, the second flow of sterile gas is controlled such to obtain a gas pressure within second space 39 which ranges between 5 kPa to 40 kPa, in particular between 10 kPa to 30 kPa, above ambient pressure. In particular, second space 39 contains the pourable product and the sterile gas; and the sterile gas being delimited between delimiting element 37 and the pourable product.

Preferentially but not necessarily, the first flow of sterile gas is controlled such to obtain a gas pressure within isolation chamber 10 which ranges between 100 Pa to 500 Pa above ambient pressure.

According to a preferred non-limiting embodiment, the first flow of sterile gas and the second flow of sterile gas are controlled by controlling respectively first control valve 48 and second control valve 49.

Preferentially but not necessarily, the first flow of sterile gas is directed into isolation chamber 10 through first gas feeding conduit 46. In particular, the sterile gas of the first flow of sterile gas is injected into isolation chamber 10 through the injection nozzle(s) and/or injection outlet(s) of injection portion 50.

Preferentially but not necessarily, the second flow of sterile gas is directed into second space 39 through second gas feeding conduit 47, in particular through main inlet portion 51, even more particular annular conduit 52.

Preferentially but not necessarily, during the pressurizing step a leakage flow of sterile gas is established from second space 39 to first space 38. In particular, sterile gas flows from second space 39 to first space 38 through fluidic channel 40.

Preferentially but not necessarily, operation of packaging apparatus 1 also comprises the step of extracting gas from isolation chamber 10. In particular, the gas is extracted from isolation chamber 10 through the sterilization space.

In particular, the gas extracted from isolation chamber 10 enters into return conduit 59 and is directed towards (and to) pressurizing unit 44.

Preferentially but not necessarily, operation of packaging apparatus 1 also comprises the step of directing a third flow of sterile gas into the sterilization space, in particular in the area of the interface between inner environment 11 and the sterilization space.

The advantages of packaging apparatus 1 according to the present invention will be clear from the foregoing description.

In particular, delimiting element 37 allows to delimit space 39, which can be pressurized by introducing the sterile gas. The pressurized sterile gas within second space 39 replaces the action of the pourable product column for obtaining the required hydrostatic pressure for correctly forming packages 2. This allows to reduce the extension, in particular the vertical extension of isolation chamber 10.

Furthermore, it is of advantage to arrange delimiting element 37 within isolation chamber 10 (in contrast to being arranged e.g. within package forming unit 15) so that in the rare case of a collapse of tube 3 and/or seam portion 23 in the area of delimiting element 37 would mean that in the worst case sterile gas and not contaminated gases would contact the inner of tube 3 and/or filling pipe 30 and/or delimiting element 37 and/or main inlet portion 51. It must be noted that such a collapse could be rarely provoked by the complex interaction between delimiting element 37, tube 3 and the sterile gas present within second space 39.

Additionally, as the hydrostatic pressure is obtained by the sterile gas and not by the pourable product column, the modification works needed to be applied to packaging apparatus 1 in case of a format change or in case of a change in the production speed are minimal and require significant less time than with respect to apparatuses in which the hydrostatic pressure is obtained by means of the pourable product column.

A further advantage resides in that due to the leakage flow of sterile gas from second space 39 to first space 38 allows to reduce the risk of the evolution of steep gradients in pressure over time.

An even other advantage lies in providing for a design of delimiting element 37 such that fluidic channel 40 is provided by a gap between the inner surface of tube 3 and delimiting element 37. Thus, there is no contact between delimiting element 37 and the inner surface of tube 3. Therefore, delimiting element 37 does not damage the inner surface of tube 3. As well, the risk of debris particles entering package 2 is significantly limited.

Clearly, changes may be made to packaging apparatus 1 as described herein without, however, departing from the scope of protection as defined in the accompanying claims.

In an alternative embodiment not shown, filling pipe 30 and main inlet portion 51 could be arranged spaced apart from, and parallel to, one another.

In a further alternative embodiment not shown, the delimiting element could be designed to abut, in use, against the inner surface of tube 3 and the delimiting element could be provided with an aperture or apertures for allowing for the at least one fluidic channel fluidically connecting the second space with the first space.

The invention claimed is:

1. A packaging apparatus for forming a plurality of sealed packages filled with a pourable product comprising:

a conveying device adapted to advance a web of packaging material along an advancement path;

an isolation chamber separating an inner environment containing a sterile gas from an outer environment;

a tube forming and sealing device being at least partially arranged within the isolation chamber and being adapted to form and longitudinally seal a tube from the, in use, advancing web of packaging material;

wherein the conveying device is also adapted to advance the tube along a tube advancement path;

a delimiting element arranged, in use, within the tube and designed to divide the tube in a first space being in fluidic connection with the inner environment and a second space being arranged downstream of the first space along the tube advancement path;

a filling device adapted to direct, in use, a pourable product into the second space (39);

a sterile gas supply device configured to generate and to pressurize a sterile gas and to divide the generated and pressurized sterile gas at least into a first flow of the sterile gas and at least a second flow of the sterile gas;

wherein the sterile gas supply device is also configured to direct the first flow of the sterile gas into the isolation chamber and the second flow of the sterile gas into the second space; and configured to control the first flow of sterile gas and the second flow of sterile gas such that the gas pressure within the second space is higher than the gas pressure within the isolation chamber.

2. The packaging apparatus according to claim 1, wherein the sterile gas supply device comprises a pressurizing unit and a sterilization assembly configured to respectively pressurize and sterilize a gas for generating the pressurized and sterile gas.

3. The packaging apparatus according to claim 2, wherein the pressurizing unit and the sterilization assembly are arranged and fluidically connected such that the sterilization assembly receives, in use, the pressurized gas so as to sterilize the pressurized gas.

4. The packaging apparatus according to claim 2, wherein the pressurizing unit is configured to extract directly and/or indirectly gas from the isolation chamber, to pressurize the extracted gas and to direct the pressurized gas to the sterilization assembly.

5. The packaging apparatus of claim 2, wherein the pressurizing unit comprises a compressor.

6. The packaging apparatus according to claim 1, wherein the sterile gas supply device comprises a first control valve configured to control the first flow of sterile gas and a second control valve configured to control the second flow of sterile gas.

7. The packaging apparatus according to claim 1, wherein the sterile gas supply device is configured such to control the gas pressure within the second space to range between 5 kPa to 40 kPa above ambient pressure.

8. The packaging apparatus of claim 7, wherein the gas pressure within the second space ranges between 10 kPa to 30 kPa above ambient pressure.

9. The packaging apparatus according to claim 1, wherein the sterile gas supply device is configured such to control the gas pressure within the isolation chamber to range between 100 Pa to 500 Pa above ambient pressure.

10. The packaging apparatus according to claim 1, wherein the delimiting element is arranged within the isolation chamber.

11. The packaging apparatus according to claim 1, wherein the tube forming and sealing device comprises a tube forming unit configured to gradually fold the web of packaging material into the tube by overlapping a first lateral edge and a second lateral edge of the web of packaging material for forming a longitudinal seal portion;

wherein the seal portion extends from an initial level into a downstream direction along the tube advancement path; and wherein the delimiting element is arranged in the area of the initial level and/or downstream of the initial level along the tube advancement path.

12. The packaging apparatus according to claim 1, wherein the delimiting element is designed to provide, in use, at least one fluidic channel for fluidically connecting the second space with the first space and for allowing, in use, a leakage flow of sterile gas from the second space into the first space.

13. The packaging apparatus according to claim 12, wherein the fluidic channel has an annular shape.

14. The packaging apparatus according to claim 12, wherein, in use, the fluidic channel is delimited by a peripheral portion of the delimiting element and the inner surface of the, in use, advancing tube.

15. The packaging apparatus according to claim 1, wherein the delimiting element is adapted to move along a direction parallel and/or a direction perpendicular to the, in use, advancing tube.

16. The packaging apparatus according to claim 1, wherein the filling device comprises at last a filling pipe, in use, at least partially extending within the tube and being adapted to direct, in use, the pourable product into the second space, wherein the sterile gas supply device comprises at least a gas feeding conduit for directing the sterile gas of the second sterile gas flow into the second space; and wherein at least a portion of the gas feeding conduit and at least a portion of the filling pipe are parallel to one another.

17. The packaging apparatus according to claim 16, wherein the delimiting element is connected to at least a portion of the filling pipe and/or to a portion of the gas feeding conduit.

* * * * *